US005499008A

United States Patent [19]

Rosenkrantz et al.

[11] Patent Number: 5,499,008

[45] Date of Patent: Mar. 12, 1996

[54] APPARATUS FOR PROVIDING ARTIFICIAL SOUNDS IN THE VICINITY OF A TOILET AND METHOD THEREOF

[75] Inventors: Evelyn Rosenkrantz, 4915 Tyrone Ave. #203, Sherman Oaks, Calif. 91423; Richard Wu, Fullerton, Calif.

[73] Assignee: Evelyn Rosenkrantz, Sherman Oaks, Calif.

[21] Appl. No.: 226,127

[22] Filed: Apr. 11, 1994

[51] Int. Cl.[6] ..... G08B 3/00

[52] U.S. Cl. ..... 340/384.7; 340/692; 4/661; 4/300

[58] Field of Search ..... 340/384.7, 692; 4/661, 300, 483, 902, 901

[56] References Cited

U.S. PATENT DOCUMENTS

| | | | |
|---|---|---|---|
| 2,440,974 | 5/1948 | Resch | 312/31 |
| 3,587,437 | 6/1971 | McEwen | 98/1 |
| 3,943,859 | 3/1976 | Boone | D6/97 |
| 4,434,938 | 3/1984 | Rosenkrantz et al. | 239/274 |
| 4,521,919 | 6/1985 | Molloy | 455/344 |
| 4,773,863 | 9/1988 | Douglas, III | 434/247 |
| 5,008,964 | 4/1991 | Dean et al. | 4/661 |
| 5,253,375 | 10/1993 | Prosper | 4/661 |
| 5,276,595 | 1/1994 | Patrie | 362/101 |
| 5,319,812 | 6/1994 | Hanrahan et al. | 4/663 |
| 5,355,537 | 10/1994 | Redford | 4/482 |

*Primary Examiner*—Brent A. Swarthout
*Assistant Examiner*—Nina Tong

[57] ABSTRACT

An apparatus is provided for providing artificial sounds in the vicinity of a toilet. It includes a housing attachable in the vicinity of a toilet and an electronic sound system which is contained within the housing and is activatable by a user of the toilet so as to block out the noise of eliminating. The sound system includes a speech processing microprocessor for providing an electronic signal representing a desired sound. A memory storage device is connected to the speech processing microprocessor for electronically storing a digital representation of the desired sound to be processed by the speech processing microprocessor. A counter is connected to the memory storage device. The counter has a clock for generating an address for the speech processing microprocessor. A variable resister is attached to the speech processing microprocessor for controlling a rate of the clock, and thereby controlling the quality of the desired sound. A switch is connected to the speech processing microprocessor for turning on the desired sound. An amplification system is connected to the speech processing microprocessor for amplifying the electronic signal. A power source provides the necessary power to the amplification system, speech processing microprocessor, memory storage device, and counter. A speaker system is connected to the amplification system for providing the desired sound being of a type so as to block out the noise of eliminating. Therefore, by engagement of the play switch at the desired time by the user, embarrassing sounds of eliminating can be minimized.

12 Claims, 4 Drawing Sheets

APPARATUS FOR PROVIDING ARTIFICIAL SOUNDS IN THE VICINITY OF A TOILET AND METHOD THEREOF

BACKGROUND OF THE INVENTION

1. Field of the Invention

The present invention relates to blocking out embarrassing noises while using the toilet and is particularly directed to an apparatus and method for providing artificial sounds in the vicinity of a toilet to block the noise of eliminating.

2. Description of the Related Art

There are numerous inventions that have been patented which are directed to eliminating embarrassing situations in restrooms. For example, present applicant is a co-applicant of U.S. Pat. No. 4,454,938 entitled AROMA SYSTEM. The '938 patent presents an aroma system for use with toilets and the like. An improved pump is combined with a container to provide a compact and trouble free system. The pump is activated by the toilet handle when the toilet is flushed. Pump activation releases a pre-selected aroma which will mask the normal toilet odor.

U.S. Pat. No. 3,587,437 discloses a ventilated paper dispenser wherein a paper roll holder is mounted in a shell having an open front. An air inlet is provided at one end of the open front other than the bottom side and leads to a connector through which a ventilating device may be connected.

U.S. Pat. No. 4,521,919 discloses a radio in the shape of an animal. The radio turns on when the toilet seat is lifted. Although the bathroom radio disclosed in the '919 patent might help offset embarrassing noises while eliminating, there is no guarantee that the noise emitted is so emitted at the precise time that an annoying occurrence appears so that the noise from the radio will block it out.

Other patents revealed in a patent search are U.S. Pat. No. 3,943,859 which is a shelf-like device which is adapted to hold one or more toilet accessories conveniently. U.S. Pat. No. 2,440,974 discloses a combined humidifier and toilet paper dispenser.

OBJECTS AND SUMMARY OF THE INVENTION

It is, therefore, a principal object of the present invention to create a desired sound at the precise moment desired to reduce embarrassment in vicinity of a toilet.

Another object is to provide an apparatus for providing artificial sounds that is economical in cost to manufacture.

These and other objects are achieved by the present invention which is an apparatus for providing artificial sounds in the vicinity of a toilet. It includes a housing attachable in the vicinity of a toilet; and an electronic sound system which is contained within the housing and is activatable by a user of the toilet so as to block out the noise of eliminating. The sound system includes a speech processing microprocessor for providing an electronic signal representing a desired sound. A memory storage device is connected to the speech processing microprocessor for electronically storing a digital representation of the desired sound to be processed by the speech processing microprocessor. A counter is connected to the memory storage device. The counter has a clock for generating an address for the speech processing microprocessor. A variable resister is attached to the speech processing microprocessor for controlling a rate of the clock, and thereby controlling the quality of the desired sound. A switch is connected to the speech processing microprocessor for turning on the desired sound. An amplification system is connected to the speech processing microprocessor for amplifying the electronic signal. A power source provides the necessary power to the amplification system, speech processing microprocessor, memory storage device, and counter. A speaker system is connected to the amplification system for providing the desired sound being of a type so as to block out the noise of eliminating. Therefore, by engagement of the play switch at the desired time by the user, embarrassing sounds of eliminating can be minimized.

Other objects, advantages, and novel features will become apparent from the following detailed description of the invention when considered in conjunction with the accompanying drawings.

BRIEF DESCRIPTION OF THE DRAWINGS

The same elements throughout the figures are designated by the same reference characters.

DETAILED DESCRIPTION OF THE PREFERRED EMBODIMENTS

Figure 1:
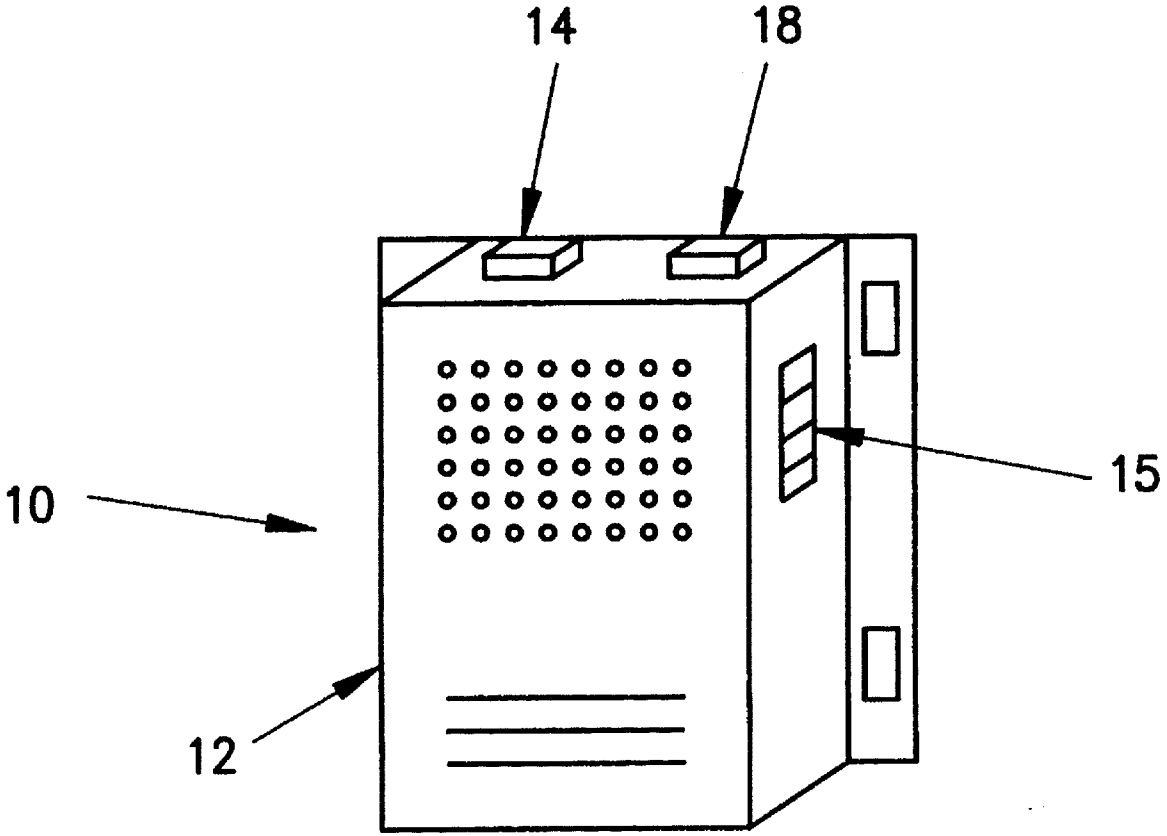
FIG. 1 is a perspective schematic illustration of the present invention.

Referring now to the drawings and the characters of reference marked thereon, FIG. 1 illustrates a preferred embodiment of the present invention, designated generally as 10. Apparatus 10 includes a housing 12, which is attachable in the vicinity of a toilet by clips, screws, or other convenient fastening mechanisms. The apparatus 10 includes a play switch 14 and volume control 16. When the play switch 14 is depressed, sound is emitted which blocks out the sound of eliminating, such as urinating or bowel movements. The sound may be, for example, music, ocean waves or the sound of a flushing toilet. A sound select button 18 may be utilized to select the desired sound.

Figure 2:
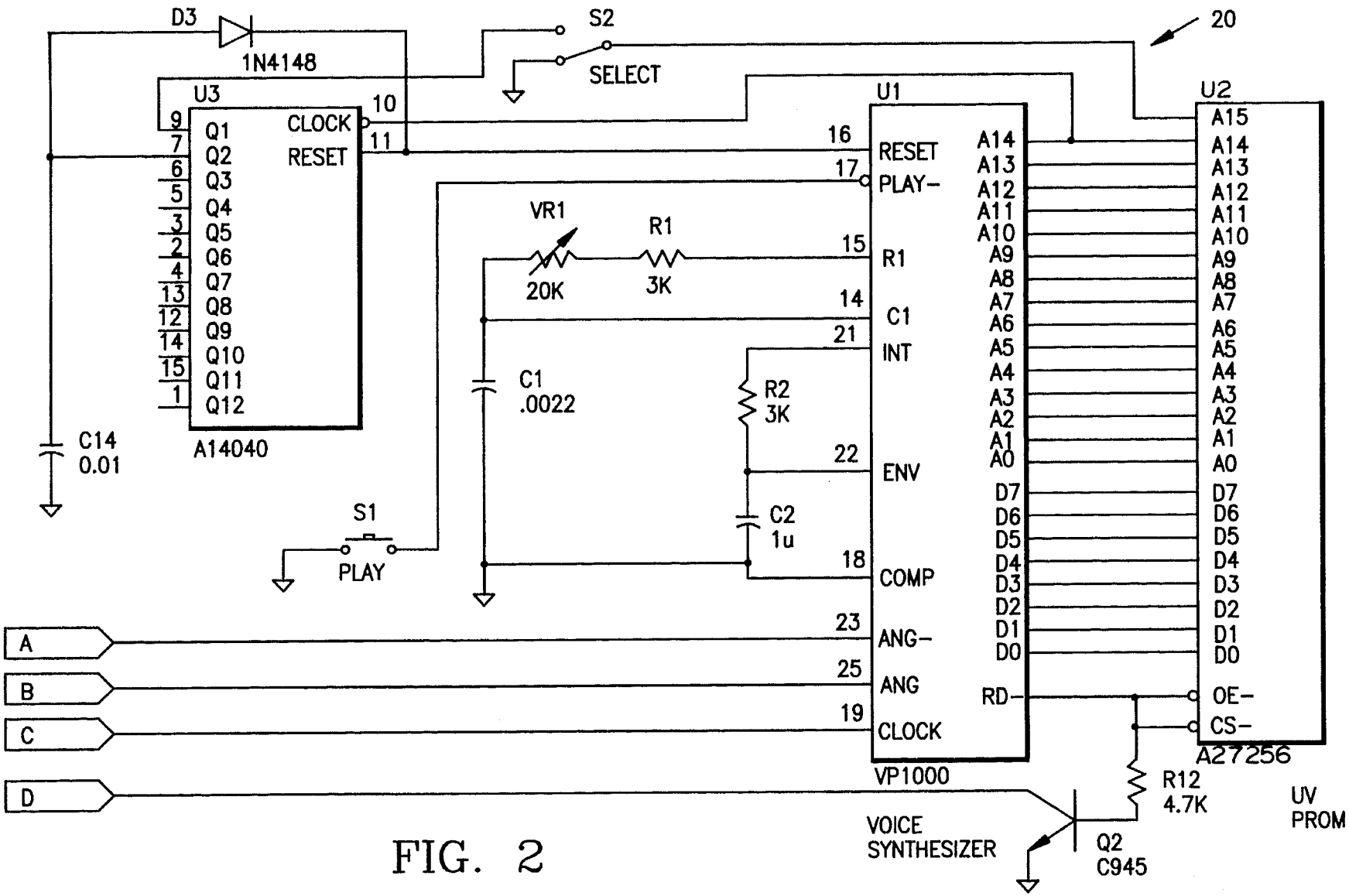
FIG. 2 is a schematic illustration showing the interactions of the speech processing microprocessor, UVPROM, and counter of the present invention.
Figure 3:
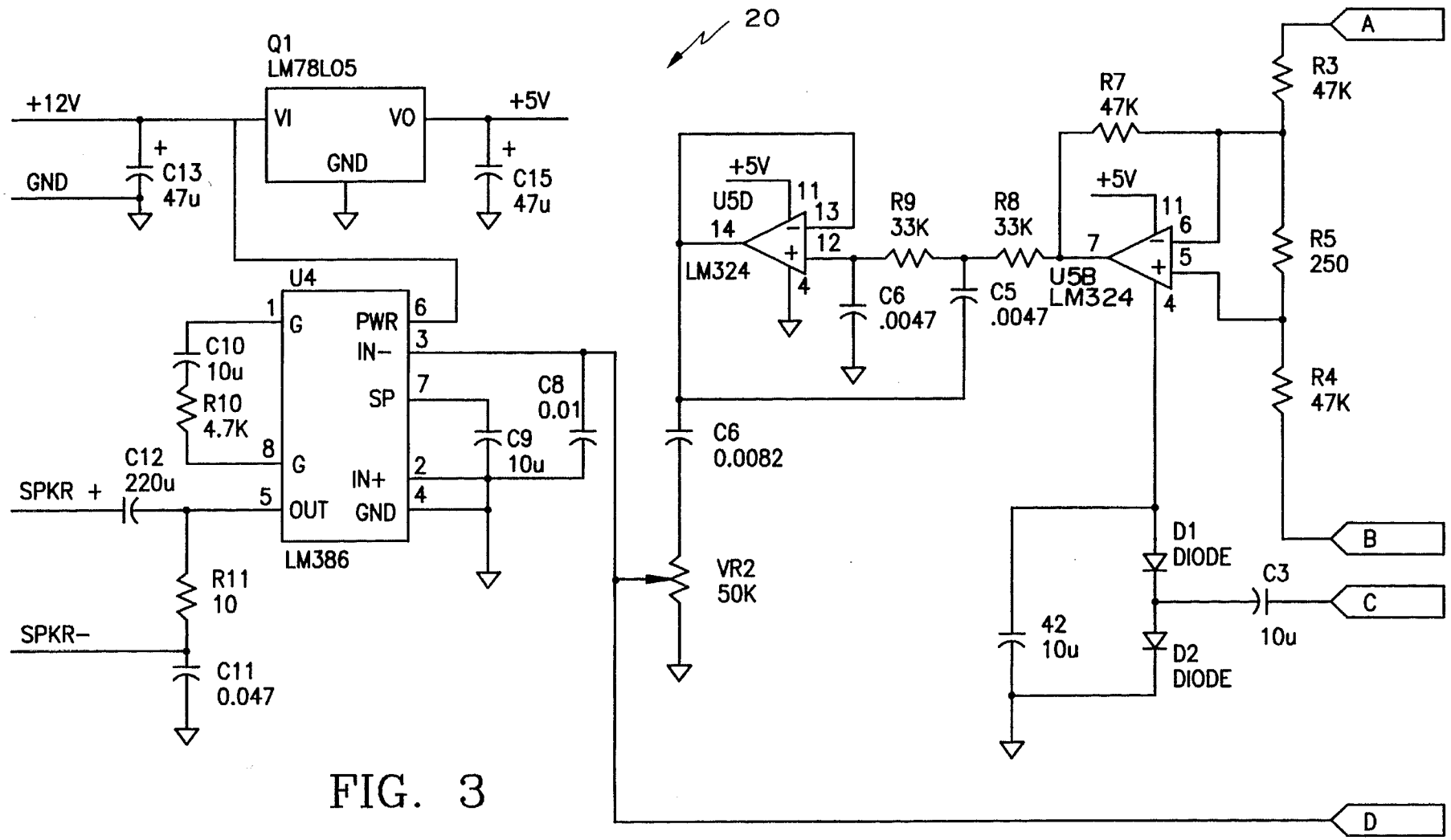
FIG. 3 is a schematic illustration of the amplification system and voltage regulator of the present invention.

Housing 12 contains an electronic sound system, designated generally as 20 in FIGS. 2 and 3. Sound system 20 includes a speech processing microprocessor U1, which provides an electronic signal representing a desired sound. U1 is preferably a model VP1000 microprocessor by Eletech, Inc.

Figure 4:
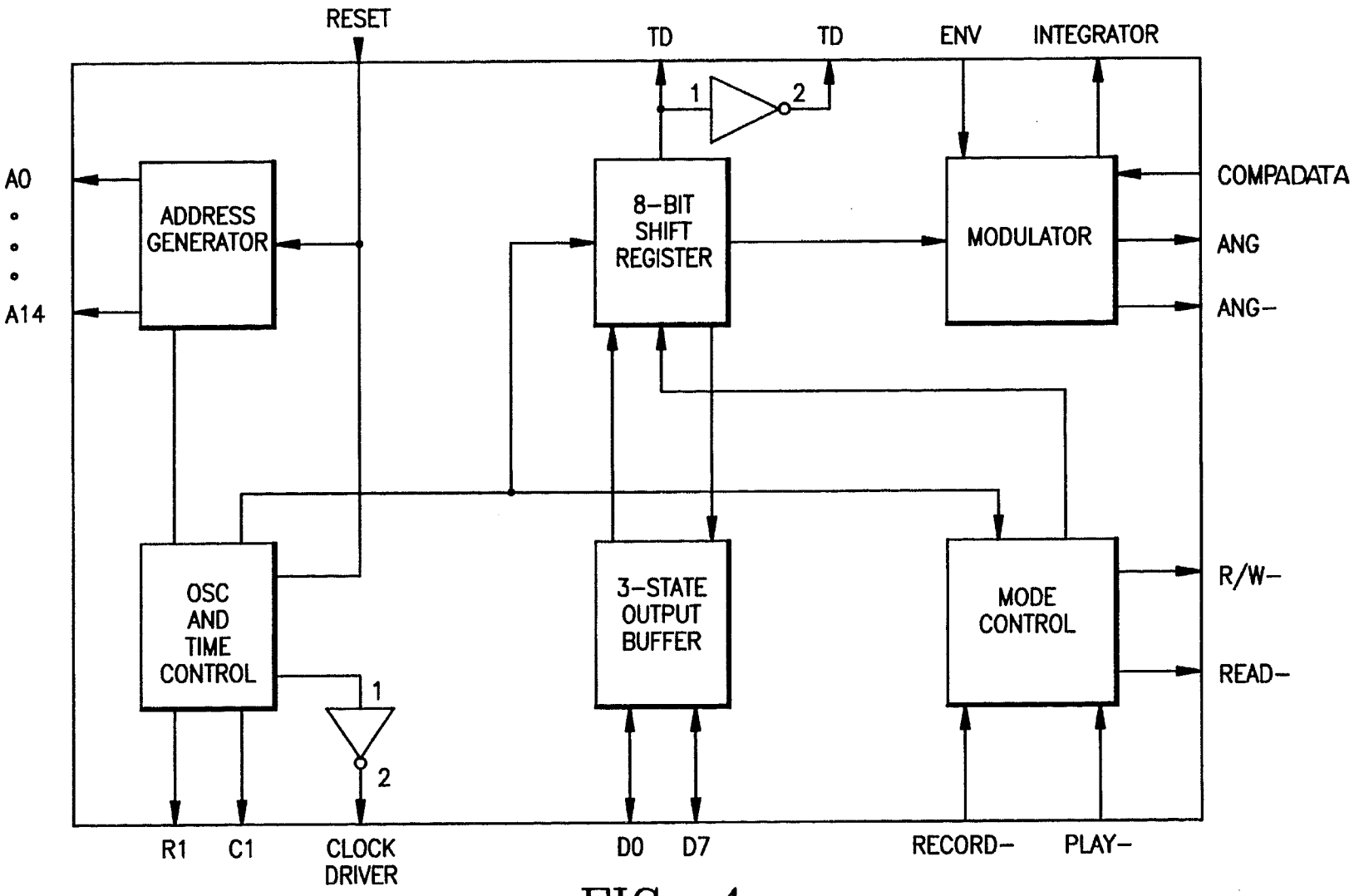
FIG. 4 (PRIOR ART)
FIG. 4 (Prior Art) is a block diagram of the VR1000 speech processor, which is the preferred microprocessor for use with the apparatus of the present invention.

FIG. 4 (Prior Art) is a block diagram of the VP1000 microprocessor. The VP1000 is a CMOS (complimentary metal-on-silicon) LSI (large scale integration) for speech analysis applications.

Referring again to FIG. 2, address buses A0–A14 and data buses D0–D7 are connected to a memory storage device U2 which electronically stores a digital representation of the desired sound to be processed by U1. U2 is preferably a UV EPROM (ultra-violet erasable programmable read only memory) such as Model A27256 manufactured by Advanced Micro Devices. This is a 256 K (32K byte) memory storage device. (The UVEPROM can be expanded to 512 K when the memory switch S2 is connected to the IC U3 pin-9 and U2 is replaced by Advanced Micro Devices Model No. A27512.) An additional UV PROM may be added to produce additional sounds. Encoding (digitizing) of the desired sounds may be accomplished at the time of chip manufacture or alternately by use of a commercially available voice development system, such as that manufactured by Eletech, Model No. VP-880. The VP-880 voice development kit is specially designed for speech ROM programming which utilizes IBM PC AT-XT as an analysis tool. The system will produce quality voice output at this amplifying rate of 24K or 32K bps as well as an acceptable voice when this amplifying rate is lower down to 12K bps.

U3 is a counter, such as Model A14040 manufactured by Motorola. U3 includes a clock for generating an address for the speech processing microprocessor U1. In addition to clock pin-10 a reset pin-11 is connected to pin-16 of U1.

A variable resistor, VR1, which is connected to U1, through a resistor R1, is connected to U1 pin-15 which controls the clock rate, and therefore output quality of the voice. (VR1 is set during the assembly of the apparatus 10 and generally not by the user.) VR1 may be, for example, a 20K OHM variable resistor.

Voice volume is controlled by element VR2, another variable resistor, preferably 50K OHMs. VR2 is connected to the output of Q2 which is a transistor, preferably Model No. C945. The voice output of the U1 pins 23 (ANG–) and 25 (ANG) is amplified through two cascaded low power amplifiers U5B and U5D of an amplification system. (Amplifiers U5B and U5D may be, for example, (Texas Instrument Model Nos. LM324.) The amplified signals are then fed into U4, a speaker driver. Speaker driver U4 may be, for example, National Semiconductor Model No. LM386.

Pin 19 (clock) of U1 is connected through C3 to diodes D1 and D2 which provide timing for U1.

The sound system 20 can use either a standard 9 volt or 12 volt battery (as shown in FIG. 3). An internal voltage regulator Q1 adjusts the power supply to +5 volts for internal use only. U1 may be, for example, National Semiconductor Model No. LM78L05. Speakers are connected at terminals SPKR+ and SPKR–, which are connected to U4, the speaker driver.

Obviously, many modifications and variations of the present invention are possible in light of the above teachings. For example, the component values shown in the figures are for the purpose of illustration and not limitation. It is, therefore, to be understood, that within the scope of the appended claims, the invention may be practiced otherwise then as specifically described.

What is claimed and desired to be secured by Letters Patent of the United States is:

We claim:

1. An apparatus for providing artificial sounds in the vicinity of a toilet, comprising:

a housing attachable in a vicinity of a toilet; and an electronic sound system which is contained within said housing and is activatable by a user of said toilet so as to block out the noise of eliminating, said sound system comprising:

a) a speech processing microprocessor for providing an electronic signal representing a desired sound;

b) a memory storage device connected to said speech processing microprocessor, for electronically storing a digital representation of said desired sound to be processed by said speech processing microprocessor;

c) a counter connected to said memory storage device, said counter having a clock for generating an address for said speech processing microprocessor;

d) resistance means comprising a variable resistor attached to said speech processing microprocessor for controlling a rate of said clock and thereby controlling the quality of said desired sound;

e) a manual switch connected to said speech processing microprocessor for turning on said desired sound;

f) an amplification system connected to said speech processing microprocessor for amplifying said electronic signal;

g) power source means for providing the necessary power to said amplification system, speech processing microprocessor, memory storage device, and counter; and h) a speaker system connected to said amplification system for providing said desired sound being of a type so as to block out the noise of eliminating.

2. The apparatus of claim 1 wherein said memory storage device comprises a UV PROM.

3. The apparatus of claim 1 further including a variable volume control element connected to said amplification system for providing a desired volume of said desired sound.

4. The apparatus of claim 1 wherein said power source means comprises a voltage regulator for adjusting the power input to said electronic sound system to +5 volts.

5. The apparatus of claim 1 wherein said amplification system comprises a plurality of low power operational amplifiers.

6. The apparatus of claim 1 wherein said amplification system comprises two cascaded low power operational amplifiers.

7. The apparatus of claim 1 wherein said amplification system comprises:

a) two cascaded low power operational amplifiers; and b) a speaker driver.

8. The apparatus of claim 1 wherein said desired sound comprises the sound of a flushing toilet.

9. The apparatus of claim 1, wherein said memory storage device comprises a UVEPROM (Ultra-Violet Erasable Read-Only Memory).

10. The apparatus of claim 1, wherein said speech processing microprocessor comprises a VP1000 CMOS speech analysis microprocessor.

11. A method for reducing the embarrassing sound of eliminating in a toilet, comprising the steps of:

a) attaching a housing in the vicinity of the toilet;

b) producing a selected sound for blocking out the noise of eliminating via a sound system by manually engaging a play switch, said sound system being contained within said housing; wherein said selected sound is produced via a speech processing microprocessor connected to said play switch;

c) storing said selected sound in a memory storage device that is coupled to said speech processing microprocessor;

d) generating an address for said speech processing microprocessor via a counter;

e) controlling a rate of a clock of said counter using a variable resistor attached to the microprocessor, thereby controlling the quality of said selected sound;

f) amplifying said electronic signal via an amplification system connected to said speech processing microprocessor; and g) powering said amplification system, speech processing microprocessor, memory storage device and counter via, at least one power source.

12. The method of claim 11 wherein said step of producing a selected sound comprises producing a sound emulating the noise of a flushing toilet.

* * * * *